United States Patent [19]

Seaquist et al.

[11] Patent Number: 4,552,424

[45] Date of Patent: Nov. 12, 1985

[54] HIGH VOLTAGE TERMINAL

[75] Inventors: James J. Seaquist, Birmingham; Elred R. Harmon, Pell City, both of Ala.

[73] Assignee: Square D Company, Palatine, Ill.

[21] Appl. No.: 551,546

[22] Filed: Nov. 14, 1983

Related U.S. Application Data

[63] Continuation-in-part of Ser. No. 409,202, Aug. 18, 1982.

[51] Int. Cl.[4] ..... H01R 27/00

[52] U.S. Cl. ..... 339/32 R; 339/263 L; 339/266 R; 339/266 L

[58] Field of Search ..... 339/272 VC, 263 L, 264 L, 339/266 L, 246, 248, 249, 32, 33

[56] References Cited

U.S. PATENT DOCUMENTS

| | | | |
|---|---|---|---|
| 2,044,679 | 6/1936 | Frese | 339/246 |
| 2,530,229 | 11/1950 | Hendley | 339/264 L |
| 2,698,151 | 12/1954 | Jenne | 339/266 L |
| 2,951,227 | 8/1960 | Cornell | 339/32 R |
| 3,001,166 | 9/1961 | Cornell | 339/32 R |
| 3,085,223 | 4/1963 | Toedtman | 339/266 R |

FOREIGN PATENT DOCUMENTS

| | | | |
|---|---|---|---|
| 1358421 | 3/1964 | France | 339/32 R |

*Primary Examiner*—Gil Weidenfeld
*Assistant Examiner*—David L. Pirlot
*Attorney, Agent, or Firm*—Stephen A. Litchfield; Richard T. Guttman

[57] ABSTRACT

An electrical connector includes a first conductive member, a second conductive clamp and a threaded fastener. The first conductive member is designed to receive conductors of different diameters in several different angular positions and can be clamped with the same conductive clamp.

6 Claims, 8 Drawing Figures

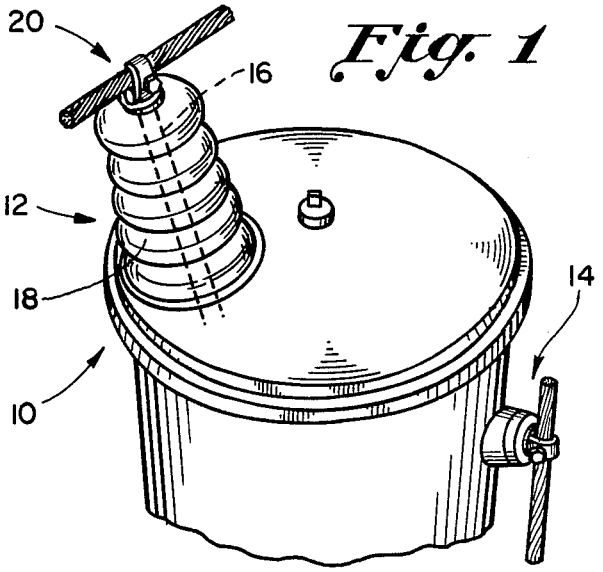
Fig. 1
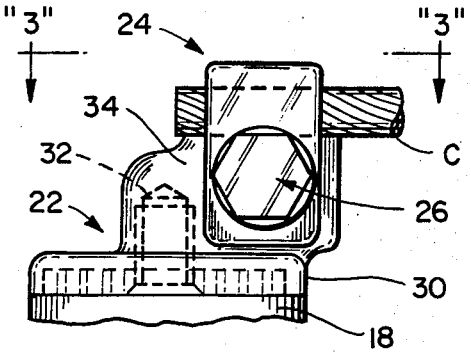
Fig. 2
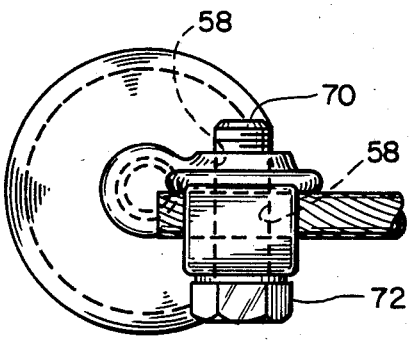
Fig. 3
Fig. 4
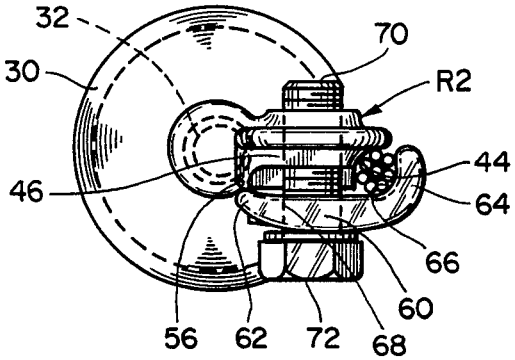
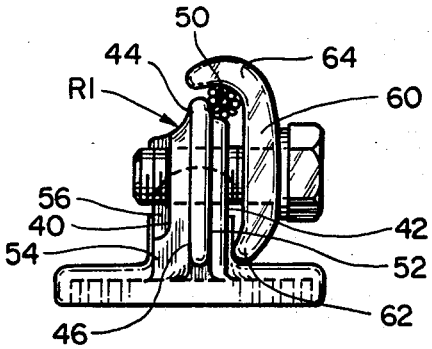
Fig. 5
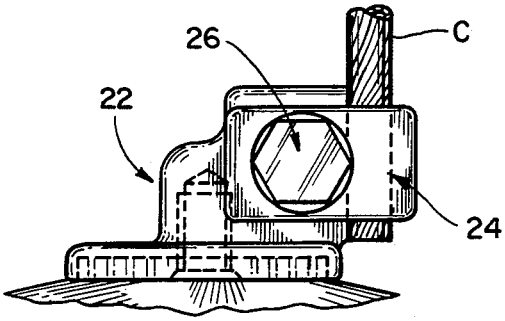
Fig. 6

HIGH VOLTAGE TERMINAL

This is a continuation in part of the copending application of common ownership entitled "Low Voltage Bushing Terminal" having the same inventors as named in the present application and having Ser. No. 409,202, filed Aug. 18, 1982 with the United Stated Patent and Trademark Office.

DESCRIPTION

1. Technical Field

The present invention relates generally to improvements in electrical connectors and, more particularly, to a terminal connector that is used for connection of conductors to electrical equipment, such as transformers, regulators and cutouts.

2. Background Prior Art

Many types of electrical connectors have been proposed and are used for establishing electrical contact between a wire or conductor and a terminal to which it is to be connected. For example, a common item in the electrical industry is a transformer which receives power from a high voltage source and reduces the power to a low voltage output. One area where such transformers are normally utilized is in residential zones wherein high voltage power lines are supported on poles and have transformers mounted on the poles. The high voltage power is received through an insulator to the transformer where the high voltage is stepped down to a residential voltage and is transmitted through low voltage conducting cables.

While numerous proposals have been made for bushing terminals for connecting the high voltage conductor to a transformer, the only acceptable type of connection is what is commonly referred to as the eye-bolt connection. Such connector consists of an eye-bolt that is supported in an opening on a main body and the conductor is threaded through the opening in the eye-bolt. A nut is then utilized to clamp the conductor between the eye-bolt and the main body. The main body is normally supported on a rod that extends through an insulator into the transformer housing.

The eye-bolt terminal or connector has several serious drawbacks, the major being the tendency for the conductor to become damaged because of possible excessive tension being applied to the clamping device. Also, the eye-bolt type of terminal provides only limited contact between the conductor and the main body, which may allow the conductor to separate from the clamp or produce a poor connection. A further shortcoming of the eye-bolt type terminal connector is the fact that the basic unit is designed for receiving the conductor at one location with respect to the transformer. For example, most commerical conductors that are presently available will have the opening extending perpendicular to the elongated axis of the insulator and the conductor must be manipulated to be received into this opening. If the conductor is to be attached in any other direction, special connectors must be provided, which adds to the overall cost of the connection and increases the time to connect the conductor to the transformer.

SUMMARY OF THE INVENTION

According to the present invention, a simplified type of connector or bushing terminal has been developed which is capable of receiving conductors at different angles with respect to the axis of the insulators on the transformer housing.

More specifically, the clamp type electrical connector of the present invention includes a main body that has a threaded bore for mounting on an insulator that forms part of a transformer. The main body has first and second angularly-related elongated arcuate recesses that provide extended contact with the conductor. A single two-position clamping member is releasably attached to the main body and has an elongated arcuate surface for engagement with the conductor with releasable clamp means interposed between the clamp member and the main body. The releasable clamp means is preferably in the form of a threaded fastener received into a threaded opening in the main body and the threaded opening is equally spaced from the two elongated recesses so that a conductor can be clamped into either of the recesses with the single clamping member.

In the specific embodiment illustrated, the conductive first member has a base which has a threaded bore and a generally rectangular body extending above the base. The first elongated recess extends substantially parallel to the axis of the threaded bore along one edge of the rectangular body and the second elongated recess extends substantially perpendicular to the axis of the threaded bore along an adjacent edge of the rectangular body. A threaded opening is located substantially at the center of the rectangular body and is equally spaced from each of the two recesses. The second member is substantially rectangular and has an elongated arcuate surface along one edge with a base extending along the opposite edge adapted to engage one surface of the main body. The second member has an opening located substantially in the center thereof which receives a threaded fastener that extends into the threaded opening in the main body and is operable to clamp the conductor between the elongated arcuate surface and either one of the two recesses in the main body.

According to one aspect of the present invention, the first and second arcuate recesses are located on one surface of the body which also has a further pair of elongated arcuate recesses on an opposed surface. The pair of recesses on the opposed surface are respectively generally aligned with the first and second arcuate recesses. The first and second recesses have a first common radius, while the pair of arcuate recesses have a second common radius which is less than the first common radius to accommodate conductors of different diameters. In addition, the rectangular body has first and second projections on the one surface adjacent the remaining edges which are engaged by the base of the second member when conductors are to be clamped in the first and second recesses, respectively.

Thus, conductors of different diameters can be clamped in any one of two different positions by the same clamping member and threaded fastener.

BRIEF DESCRIPTION OF SEVERAL VIEWS OF DRAWINGS

FIG. 1 is a fragmentary view of a conventional transformer having the electrical connector or bushing terminal of the present invention associated therewith;

FIG. 2 is a side elevation view of the electrical connector with the conductor held in one position;

FIG. 3 is a top view of the electrical connector, as viewed along line 3—3 of FIG. 2;

FIG. 4 is a view similar to FIG. 3 showing the electrical connector in a second position;

FIG. 5 is a side elevation view of the electrical connector shown in FIG. 2; and, FIG. 6 is an end view of the electrical connector showing a further modified clamping position.

DETAILED DESCRIPTION

Figure 7:
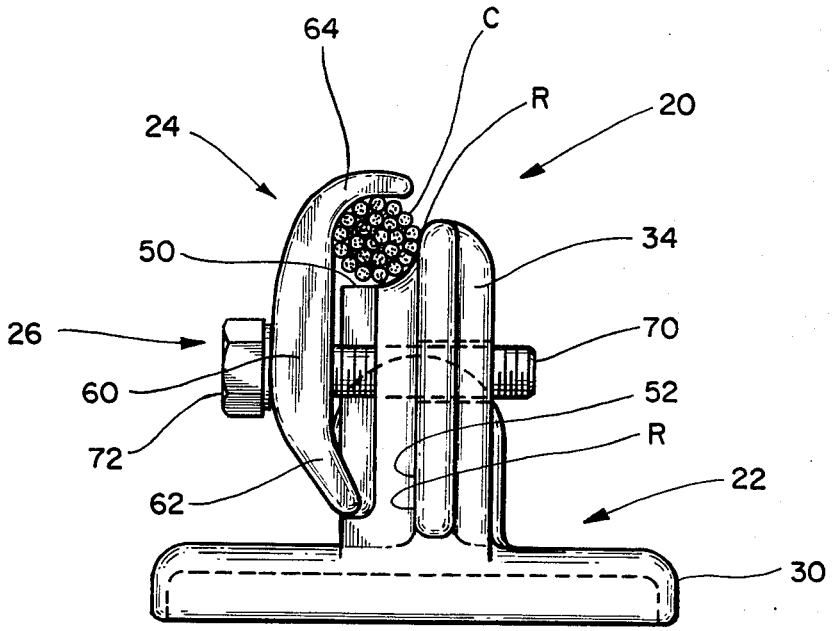
FIG. 7 is a side view of an alternative embodiment of the electrical connector.

While this invention is susceptible of embodiment in many different forms, there is shown in the drawings and will herein be described in detail a preferred embodiment of the invention with the understanding that the present disclusure is to be considered as an exemplification of the principles of the present invention and is not intended to limit the invention to the embodiment illustrated.

FIG. 1 of the drawings discloses a conventional transformer generally designated by reference numeral 10 having a high voltage input, generally designated by reference numeral 12, and a low voltage output, generally designated by reference numeral 14. As is conventional in transformers of this type, input 12 is preferably in the form of an elongated conductive rod 16 that is surrounded by an insulator 18 and has a bushing terminal 20 on the outer end thereof.

The bushing terminal or electrical connector 20 forms the subject matter of this invention and includes a first and second conductive member 22 and 24 for gripping a conductor (C), shown in FIG. 2. The conductive first member 22 is preferably a cast bronze alloy that has a base 30 which has a threaded bore 32 for mounting onto the outer end of conductive rod 16 supported within the insulator 18.

First conductive member 22 also has a generally rectangular elongated body 34 extending above base 30 which is generally laterally offset to one side of the center of the base 30 defined by the axis of threaded bore 32. Elongated body 34 has generally opposed surfaces 40 and 42 (FIG. 5). As illustrated in FIGS. 4 and 5, first and second angularly-related recesses 44 and 46 are preferably arcuate in cross-section and have a common radius (R1) with the recesses being located on adjacent edges of surface 40.

Generally rectangular body 34 also has third and fourth recesses 50 and 52 located in the opposite surface 42 thereof. Recesses 50 and 52 are respectively generally aligned with recesses 44 and 46 and have a radius (R2) which is preferably smaller than the radius (R1). Elongated rectangular body 34 also has first and second projections 54 and 56 extending outwardly from surface 40 and located generally parallel to the respective elongates recess 44 and 46. The respective projections 54 and 56 are preferably respectively equally spaced from the respective arcuate recesses 44 and 46, for a purpose that will be described later.

The second conductive member 24 includes a generally rectangular body 60 (FIG. 4) which has an elongated base 62 at one end thereof and a generally arcuate end portion 64 at the opposite end thereof. An exposed generally arcuate elongated surface 66 is defined along the inner surface of the arcuate end portion 64 of clamping member 24. An unthreaded opening 68 extends through the center of main body 60. It should be noted from an inspection of FIG. 4 that the opposite end portions 62 and 64 are laterally offset towards one side of elongated main body 60, for a purpose that will be described later.

The third component of the bushing terminal or electrical connector includes the clamping means 26 which is preferably in the form of a threaded fastener that has a threaded body portion 70 and an enlarged head 72 at one end with threaded portion 70 adapted to be threadedly received into threaded opening 58 in the elongated main body 34.

As is evident from the above description, the unique compact electrical connector 20 is capable of securely clamping the conductors of different diameters at different angles with respect to the axis of the supporting rod 16. For example, as illustrated in FIGS. 2 and 3, a larger diameter conductor (C) can be positioned to extend perpendicular to the axis of threaded bore 32 and be received into elongated arcuate recess 46 to provide extended surface contact between the conductive body 34 and the conductor (C). The clamping member 24 is then positioned to have arcuate elongated surface 66 generally aligned with surface 46 and threaded member is extended through the unthreaded opening 68 in clamping member 24 and is received into the threaded opening 58 in elongated rectangular body 34. In the clamped position, base portion 62 of clamping member 24 is in extended surface contact with projection 54 and defines a pivot point for the clamping member on the elongated rectangular body.

If the conductor (C) is positioned such that it is more desirable to clamp the conductor in a position extending generally parallel to the axis of threaded bore 32, the conductor is positioned in arcuate recess 44 and the clamping member 24 is positioned as illustrated in FIGS. 4 and 5 wherein the elongated base portion 62 is in extended engagement with the projection 56 and is pivoted at that end to securely clamp the conductor (C) between surfaces 44 and 66, as illustrated in FIG. 4.

If the conductor is of smaller diameter, the respective recesses 50 and 52 can be utilized for clamping the conductor securely between the two conductive members 22 and 24. In this instance, the base end 62 engages the adjacent surface 42 along one end of the rectangular surface. Since opposite ends 62 and 64 are laterally offset to one side of main body 60, smaller diameter conductors can be securely clamped without interference between main body 60 and rectangular body 34.

As can be appreciated from the above description, the novel compact bushing terminal is capable of connecting a plurality of different size conductors in a plurality of different positions utilizing the same three basic components without any additional special adapters.

Figure 8:
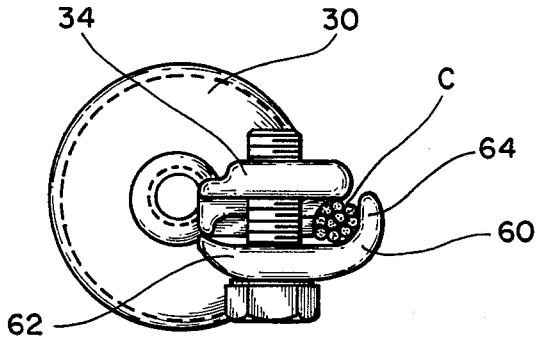
FIG. 8 is a top view of the alternative embodiment shown in FIG. 7.

FIGS. 7 and 8 illustrate an alternative embodiment of the electrical connector 20 wherein only one side of the rectangular body 34 has arcuate recesses 50 and 52, each having a common radius R. The electrical connector 20 shown in FIG. 7 has first conductor member 22 and second conductor member 24. Further, clamping means 26 is used to clamp members 22 and 24 together. Conductor C is shown clamped between end portion 64 of main body 60 and elongated body 34. Conductor C fits within recess 50. Opposite end portion 62 of main body 60 rests adjacent the elongated body 34 near recess 52 and is stabilized in this position by clamping means 26. Clamping means 26 has threaded body portion 70 and enlarged head 72. Connector 20 has base 30 similar to base 30 of the embodiment disclosed in FIGS. 1 though 6. FIG. 8 illustrates the top view of alternative embodiment electrical connector 20.

The embodiment shown in FIGS. 7 and 8 does not have the flexibility of the embodiment disclosed in FIGS. 1 through 6, however, it would be more economical to manufacture where the conductor diameter to be used is known and not likely to change. This embodiment still retains the objects and advantages of the embodiment shown in FIGS. 1 through 6 as the conductor can be connected either horizontally or vertically with respect to the transformer.

Of course, numerous modifications come to mind without departing from the spirit of the invention. For example, the respective pairs of arcuate elongated recesses in opposed surfaces of the rectangular body need not extend perpendicular to each other and could define different angles. Furthermore, as many as three or four elongated recesses could be defined in each of the surfaces and have different angular relation with respect to the threaded bore. Also, if desired, the respective surfaces 40 and 42 could be other than parallel as shown and described.

We claim:

1. A clamp-type electrical connector comprising a main body having first and second angularly related elongated recesses, each adapted for extended engagement with a conductor, a clamping member having an elongated arcuate surface adapted to be aligned with either of said recesses, and means between said body and member for clamping a conductor between said arcuate surface and one of said recesses, said main body further having a pair of elongated arcuate recesses defined therein, said pair of elongated arcuate recesses angularly related to the first and second elongated recesses; said elongated body being generally rectangular and said first and second recesses extending along one edge of said body and said pair of recesses extending along an adjacent edge of said body; said elongated body further having first and second projections extending from one of said surfaces adjacent the edges; said main body having a base which includes a threaded bore and said pair of recesses extending parallel to said body; said elongated body also having a threaded opening at substantially the center thereof and said clamping member having an unthreaded opening at substantially the center thereof and in which said clamping member comprises a threaded stud extending through said unthreaded opening into the threaded opening so that the clamping member can be retained in any one of four positions on said elongated body with the complementary arcuate surface cooperating with a different recess on said elongated body in each position.

2. A clamp-type electrical connector as defined in claim 1 in which said elongated recesses extend substantially perpendicular to each other so that said conductor can be at either of two substantially perpendicular positions with respect to said main body.

3. A clamp-type electrical conductor as defined in claim 1 in which said clamping member is substantially rectangular with said elongated arcuate surface extending along one edge of said member and in which said clamping member has an elongated base extending along an edge opposite said one edge for engaging said main body and defining a pivot point for said clamping member on said main body.

4. A high voltage bushing terminal comprising a conductive first member having a threaded bore for connecting to an insulator, said first member having a first elongated recess extending substantially parallel to the axis of said threaded bore and a second elongated recess angularly related to said axis of said threaded bore, said first member having generally opposed surfaces with said first and second recesses located in one of said surfaces and in which the other surface has third and fourth elongated recesses respectively aligned with said first and second recesses, said first member having a threaded opening equally spaced from said first and second recesses, a second member having an elongated arcuate surface along one edge and a base along an opposite edge with an opening between said arcuate surface and said base, and a threaded fastener extending through said opening in said second member and received in said threaded opening to be operable to clamp a conductor between said elongated arcuate surface and each of said recesses independently.

5. A high voltage bushing terminal as defined in claim 4 in which said second elongated recess extends substantially perpendicular to said axis so that a conductor can be clamped either in axial alignment with said axis or substantially perpendicular to said axis.

6. A bushing terminal for gripping a conductor comprising a first member including a base having an elongated body extending therefrom with opposed generally parallel surfaces, said first member having first and second elongated, exposed arcuate recesses in the respective surfaces and said recesses extending generally parallel to each other, said arcuate surfaces having different radii, a single clamping member having a complementary elongated arcuate recess, and fastener means for releasably retaining said clamping member in one of two positions on said elongated body respectively adjacent said parallel surfaces; said body having a further pair of elongated arcuate recesses in said surfaces extending parallel to each other and angularly related to said first and second arcuate recesses; said elongated body being generally rectangular and said first and second recesses extending along one edge of said body and said pair of recesses extending along an adjacent edge of said body; said elongated body also having first and second projections extending from one of said surfaces adjacent the edges; said base having a threaded bore and said pair of recesses extending parallel to said bore; said elongated body also having a threaded opening at substantially the center thereof and said clamping member having an unthreaded opening at substantially the center thereof and in which said fastener means includes a threaded stud extending through said unthreaded opening into the threaded opening so that the clamping member can be retained in any one of four positions on said elongated body with said complemementary arcuate surface cooperating with a different recess on said elongated body in each position.

* * * * *